United States Patent [19]

Ferioli

[11] Patent Number: 4,641,714

[45] Date of Patent: Feb. 10, 1987

[54] MULTIUSE PORTABLE EQUIPMENT FOR DRIVING ROTATING TOOLS, ROTATING PERCUSSION TOOLS AND PERCUSSION TOOLS

[76] Inventor: Filippo Ferioli, Via Vallara, 30, 21055 - Gorla Minore (VA), Italy

[21] Appl. No.: 727,805

[22] Filed: Apr. 26, 1985

[51] Int. Cl.[4] ..... B25D 11/00

[52] U.S. Cl. ..... 173/109; 173/119; 192/113 A

[58] Field of Search ..... 173/104, 109, 117, 119; 192/113 A

[56] References Cited

U.S. PATENT DOCUMENTS

| | | | |
|---|---|---|---|
| 1,478,294 | 12/1923 | Patterson | 192/113 A |
| 1,529,191 | 3/1925 | Kettering | 192/113 A |
| 2,850,131 | 9/1958 | Maurice et al. | 192/113 A |
| 3,695,365 | 10/1972 | Schädlich | 173/109 |
| 3,841,418 | 10/1974 | Biersack | 173/109 |
| 3,924,691 | 12/1975 | Brännström | 173/109 X |

*Primary Examiner*—James M. Meister
*Assistant Examiner*—John L. Knoble
*Attorney, Agent, or Firm*—Bucknam and Archer

[57] ABSTRACT

The present invention provides multi-use-portable equipment, particularly suitable for driving rotating tools, as well as percussion and rotating tools, and percussion tools only. More specifically, it provides portable equipment driven by a small combustion engine which is connected to a tool post by a reduction gear engaged through a ventilated clutch. Depending on the requirement, the driven tool can be a rotating tool only, or a percussion tool, or a suitable combination of these two tools.

3 Claims, 7 Drawing Figures

MULTIUSE PORTABLE EQUIPMENT FOR DRIVING ROTATING TOOLS, ROTATING PERCUSSION TOOLS AND PERCUSSION TOOLS

BACKGROUND OF THE INVENTION

The present invention relates to multi-use-portable equipment, particularly suitable for driving rotating tools, as well as percussion and rotating tools, and percussion tools only. Several types of portable equipment are known, such as hand drills and hammer drills suitable for driving tools, particularly for drilling materials.

These types of equipment, which are usually electrically or air driven, are plagued with problems when they have to operate in areas without adequate power lines or areas that cannot be easily reached with portable electric generators or air compressors.

SUMMARY OF THE INVENTION

The present invention offsets those difficulties with multiuse-portable equipment capable of satisfying practically any requirement of drilling or chipping under complete autonomy of operation, i.e., without the need for connection to an external power line or to a portable electric generator.

The present invention also provides equipment having a high efficiency drilling action when operating as a rotating and a percussion tool. Moreover, the invention further provides a portable equipment capable of accomplishing several jobs, yet being light weight and of small dimensions.

According to the present invention there is provided portable equipment including a combustion engine, a reduction gear coupled to said engine by a clutch system, a tool post mechanically connected to said reduction gear, and a percussion member working together with said tool post to power a tool on the tool post with percussions at a rate between 3.6 and 4.2 per turn of said tool post.

BRIEF DESCRIPTION OF THE INVENTION

The present invention will be further illustrated by way of the accompanying drawings, in which.

Figures 1, 4:
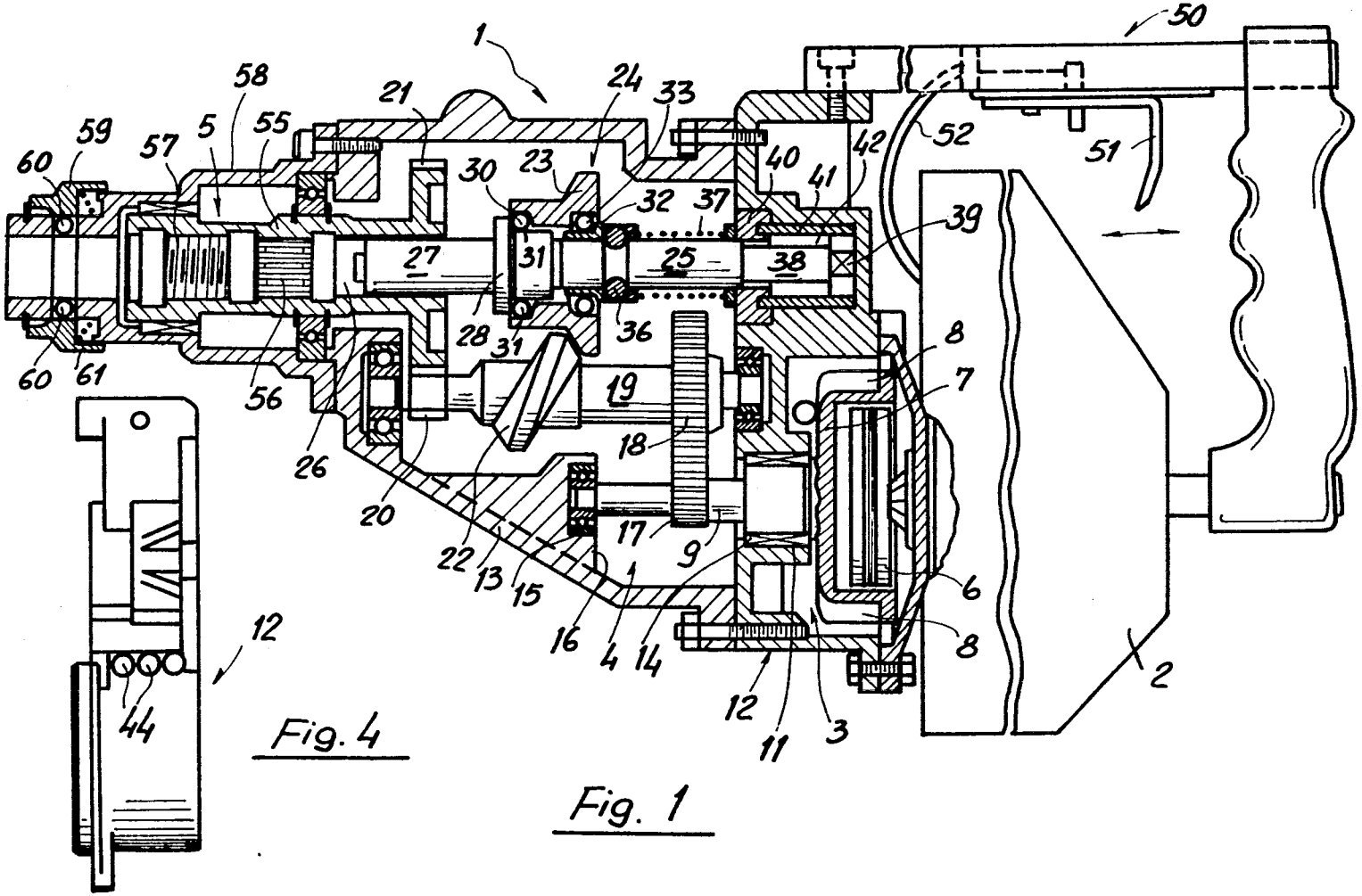
FIG. 1 is a partial cross-section along a plane containing the axis of the tool post of equipment according to one embodiment of the invention shown as a side elevation.
Figure 5:
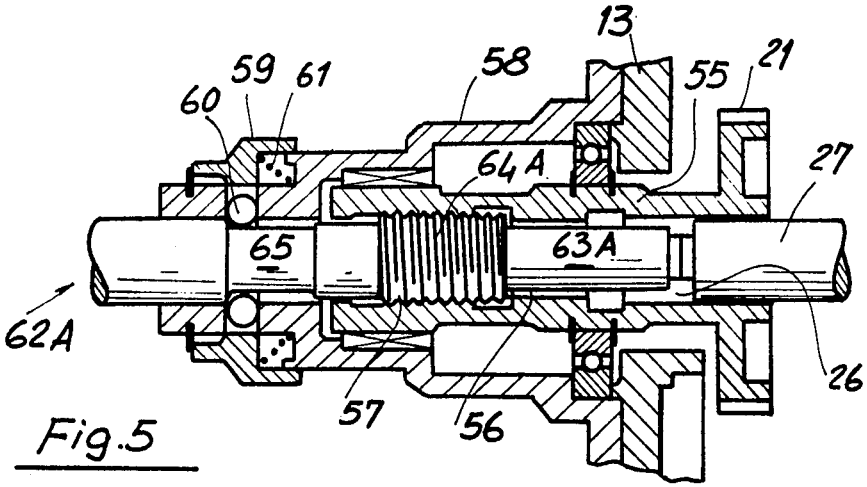
Figure 6:
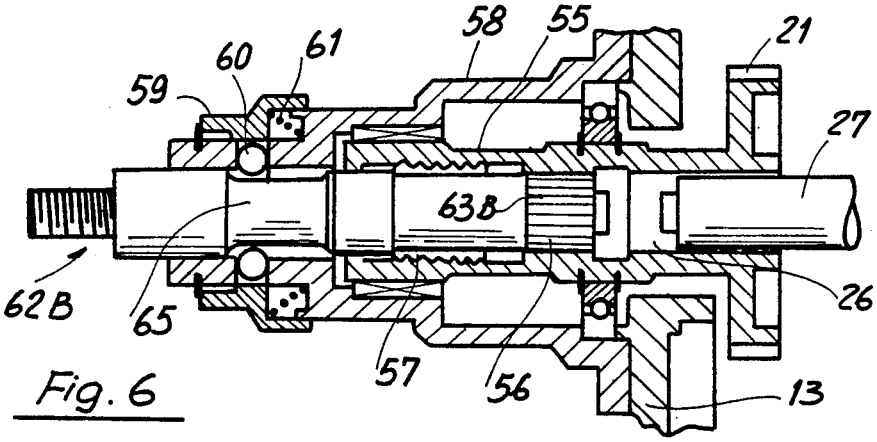
Figure 7:
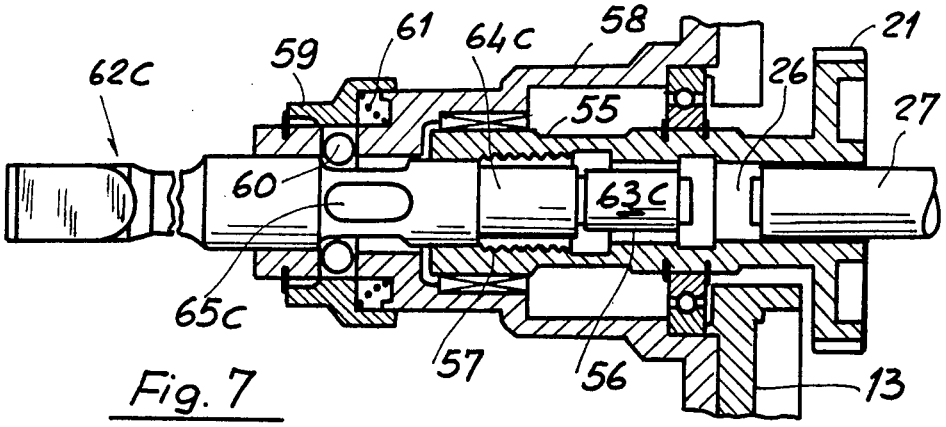

FIG. 4 which is on the same sheet as FIG. 1, is a detail of part of the case of portable equipment in correspondence to the clutch system; and FIGS. 5 to 7 are cross-sections of the coupling of a tool to a tool shaft according to the type of operation required by the portable equipment.

DESCRIPTION OF THE PREFERRED EMBODIMENT

Referring to the accompanying drawings and in particular to FIG. 1, the portable equipment 1, comprises a combustion engine 2, preferably a two-stroke small size engine incorporating a fuel tank (not shown) connected by a clutch system 3 preferably a centrifugal clutch, to a reduction gear 4 that is set into motion by the combustion engine 2 and drives the tool post 5.

Clutch 3 comprises a rotating member 6 adapted to be mechanically coupled to a bell 7 when a set speed is reached. Such bell 7 has on its periphery, on the external side relative to the surface that couples to the rotating member 6, a plurality of fins 8 for cooling clutch 3. The bell 7 carries a shaft 9 on the side opposite to the engine 2. The shaft 9 extends through a seat 11 in the frame 12 of the equipment by which the combustion engine 2 is connected to casing 13 of the reduction gear 4. After passing seat 11 via a bearing 14, the end of shaft 9 on the opposite side of bell 7 extends into another bearing 15 carried by spur 16 of casing 13. The bell 7 is therefore supported from two positions thus avoiding undesirable vibrations being set up which would affect after a short time the good operation of the equipment.

In the space between bearings 14 and 15, a gear assembly 17 is splined to the shaft 9. Gear assembly 17 is connected to another gear 18 carried by an intermediate shaft 19. On the intermediate shaft 19, on the opposite side to gear 18, there is a second gear 20 mechanically coupled to gear 21 of the tool post. In the intermediate position between gear 18 and gear 20 on shaft 19 there is also an annular cam 22 whose profile is preferably of a trapezoidal thread with only one beginning. The thread runs for at least a portion of the perimeter of shaft 9. This thread acts on a cap 23 of a percussion member 24. The cap 23 is coaxially carried by a percussion shaft 25 which is idly mounted within an axial cavity 26 of the tool post 5, and comprises a percussion head 27 which is the real percussion member extending axially within cavity 26. In correspondence to cap 23, shaft 25 has a bulge which forms, on the side opposite to the percussion member 27 and facing one end of the cap 23, and together with such cap 23, a seat 30 for several balls 31. These balls act as a support for the rotation of the cap on shaft 25. On the side opposite to seat 30 the cap 23 has an annular profile which forms, together with a sleeve 32 coaxially mounted on shaft 25, another seat 33 for more balls for the support for the cap 23. This configuration provides a particularly robust structure of the percussion member 27 which is necessary because of the high percussion rate on the tool, for each turn of the tool post 5. In particular, a specific ratio has been established between the number of turns of the tool post 5 and the number of hits of the percussion member 27 which optimizes the drilling efficiency of the tool. By adopting a ratio of four hits per turn of the tool post 5, it is difficult for a tool mounted on the tool post 5 to drill because such tool will be always be at the same angular position relative to the bottom of the hole drilled in the material. Therefore, one would get in such a hole four small which will impede a speedy penetration of the tool. If a ratio of 4.2 hits per turn of the tool post 5 is used, the drilling rate improves because the tool is hit in different positions relative to the bottom of the hole at each turn. From experimental tests it has been found that a ratio of 3.8 hits per turn yields the best results in drilling operations by percussion and rotation together. As soon as the material to be drilled is hit and because of the rotation of the tool, a cut is made which, when carefully examined, shows one sound face whereas the opposite face is porous and minutely crushed. By using the aforementioned ratio of 3.8 hits per turn the tool will always hit the crushed face, thus removing much more material than in the previous case.

Consequently, the working efficiency of the tool will be greatly improved.

Sleeve 32 is kept in place by a flexible metal ring 36 seated in a groove of the shaft 25. Between the metal ring 36 and the part 12 of the casing there is a helical spring 37 that pushes the whole shaft 25 towards gear 21. Remote from the percussion member 27 shaft 25 terminates in a part 38 reduced cross-section whose end 39 is guided, by ring 40 acting on part 38 and a bushing 41 disposed behind the ring 40 relative to spring 37, in a seat 42 of part 12 of the casing.

Figure 3:
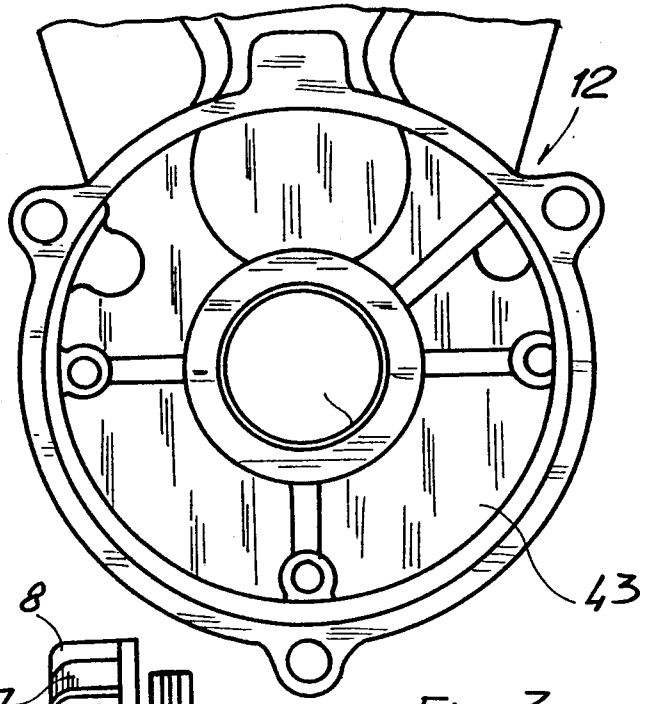
FIG. 3 is an enlarged view of the seat for the clutch system of the equipment of FIG. 1.
Figure 2:
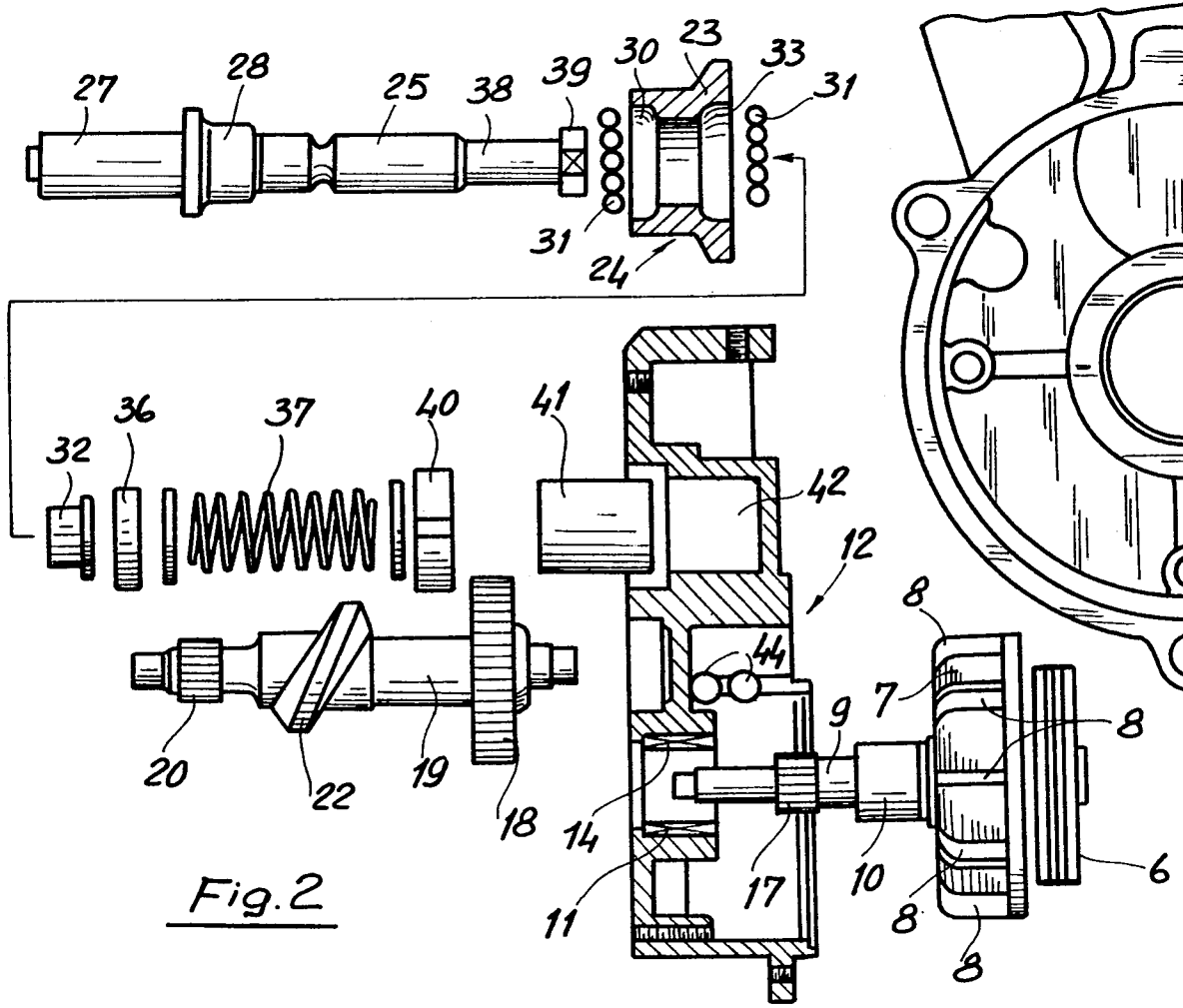
FIG. 2 is an exploded view showing some components of the reduction gear and of the clutch system of the equipment of FIG. 1.

Bell 7 of the clutch system can turn in a spiral chamber 43 which is shown in detail in FIG. 3. This chamber 43 forms a box for centrifugal ventilation by taking cool air through holes 44 by means of the fins 8 located on the bell. An equal number of holes are on the side opposite to the chamber for exhausting the cooling air, as shown in FIG. 4.

In order to use the equipment, a handgrip 50 is attached to part 12 of the casing and, ultimately, to engine 2. This handgrip has an acceleration trigger 51 which controls, through a flexible drive 52, the number of turns of the engine, by acting on the engine carburator.

The tool post 5 preferably includes a hollow shaft 55 in the interior of which and aligned with chamber 26 is disposed a grooved member 56 and a threaded member 57. The operations of these members will be explained later. The hollow shaft, which is an integral part of gear 21, can turn in a fixed supporting cap 58 connected to casing 13. A movable cap 59 slides against a spiral spring 61 over the fixed cap 58 by means of balls 60 to hold a tool 62 connected to the equipment. In particular, if a tool 62A is used for rotation only as shown in FIG. 5, it will be provided with a tang 63A which does not engage that part 56 of the tool post. Tang 63A is also provided with a thread 64A which can be screwed to the corresponding part 57 of the tool post 5. The effect of screwing is to permit tool 62A to penetrate further into the tool post 5 until it touches the end of shaft 25 and pushes spring 37. Cap 23 will then back up until it does not further interfere with cam 22, eliminating in this way the percussion action of the percussion member. For the combined effect of percussion and rotation, a tool 62B such as shown in FIG. 6 is used. This tool 62B is provided with a grooved tang 63B, but does not have a thread that engages part 57 of the hollow shaft. In both cases there is, in correspondence to balls 60 of the movable cap, an undercut 65 so that the balls may impede the exit of the tool but not its rotation relative to the movable cap 23. For a tool with percussion action only as shown in FIG. 7 where such tool is referred to as 62C, tang 63C is not provided with grooves. In this way it will not rotationally engage the hollow shaft and the thread will not engage the corresponding part 64C of the tool.

In this case, instead of the metal ring, there are small tangential grooves 65C for engaging the balls so as to tightly connect the rotation tool to the fixed cap. The operation of the equipment according to the invention should be clear by now from the description and the figures. In particular, it should be noticed that, as soon as the engine runs, it will drag the rotating part 6 of the rotating clutch. Thereafter, as soon as a set number of turns is reached which can be calibrated depending on the type of clutch, the rotating part 6 will engage the bell 7 thus setting the latter into rotation. A ventilation action is set up that keeps the temperature of the bell 7 low despite the high friction play and thus greatly improves the reliability of the equipment at a given time.

Shaft 19 is set into rotation by means of shaft 9 and in particular by means of gear 17. Shaft 19, on one hand, drives the tool post 5 through coupling 20–21 and, on the other hand, interacts through cam 22 with cap 23 thus pushing the percussion member backwards and then releasing it. Under the action of spring 37 the percussion member is thrown forward in order to bring the hitting head 27 against the tool installed in post 5, thus combining the rotation effect with the percussion effect.

It should be noticed that the rotating support of the cap 23 on shaft 25 obtained with seats directly grooved on the shaft, on sleeve 32 and on the cap itself yields a remarkable strengthening of the percussion member, thus greatly improving the characteristics of the equipment.

The replacement of the tools is particularly easy in that it is only required to overcome the action of the spiral spring 61, thus pushing the movable cap backwards. This has the effect of disengaging the balls from the tool so that the latter can be removed, eventually by unscrewing it in case the tool is for rotation only and in case thread 64A is screwed to part 57 of the hollow shaft.

The embodiments of the invention in which an exclusive property or privilege is claimed are defined as follows:

1. A multiuse portable equipment for driving rotating tools, rotating-percussion tools and percussion tools, comprising a combustion engine, a reduction gear assembly coupled to said combustion engine by a centrifugal clutch system, and a tool post mechanically connected to said reduction gear assembly, said clutch system including a rotatable finned bell rotatably supported at two positions and mounted on a spiral chamber provided with inlet and outlet holes for cooling air, and a percussion assembly effective to act on a tool carried by said tool post, said percussion assembly including a percussion shaft having at one end a percussion member and slidingly carrying at the other end a rotatable cap urged by a spring mounted on said percussion shaft, said cap being able of engaging, to be slidingly displaced on said percussion shaft, with an annular cam supported on a rotatable intermediate shaft, said intermediate shaft further supporting a gear of said reduction gear assembly said gear engaging a further gear of said reduction gear assembly, supported on a further driving shaft effective to rotatively drive said intermediate shaft, said intermediate shaft driving said tool post through a coupling gear assembly, said percussion shaft being idly mounted within an axial cavity of said tool post and having, in correspondence to said cap, a bulge forming, on the side opposite to said percussion member and facing one end of said cap, and together with said cap, a seat effective to receive a plurality of balls for rotatably supporting said cap, said reduction gear assembly ratio being so designed that said percussion member is effective to act on a said tool supported by said tool post with intermittent percussions at a rate of between 3.6 and 4.2 per turn of said tool post.

2. A multiuse portable euipment according to claim 1, wherein said rate is 3.8 per turn.

3. a multiuse equipment according to claim 1, wherein said tool post includes a hollow shaft, a part of which forms the seat for an axial hitting head of said percussion assembly, another part of said hollow shaft being adapted for rotatable coupling with a said tool, and a threaded part permitting a contact to be established between said tool and a hitting part of said percussion assembly disengaging at the same time said cap from said annular cam.

* * * * *